US010273122B2

(12) United States Patent
Hess et al.

(10) Patent No.: US 10,273,122 B2
(45) Date of Patent: Apr. 30, 2019

(54) CLIMBING DEVICE FOR A TOWER CRANE

(71) Applicant: Liebherr-Werk Biberach GmbH, Biberach an der Riss (DE)

(72) Inventors: Alfred Hess, Gutenzell-Hurbel (DE); Willi Ackermann, Eberhardzell (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 200 days.

(21) Appl. No.: 15/255,033

(22) Filed: Sep. 1, 2016

(65) Prior Publication Data

US 2017/0008740 A1 Jan. 12, 2017
US 2019/0084810 A9 Mar. 21, 2019

Related U.S. Application Data

(63) Continuation of application No. PCT/EP2015/000529, filed on Mar. 10, 2015.

(30) Foreign Application Priority Data

Mar. 11, 2014 (DE) ..... 20 2014 002 263 U
Apr. 24, 2014 (DE) ..... 20 2014 003 465 U

(51) Int. Cl.
*B66C 23/28* (2006.01)

(52) U.S. Cl.
CPC ..... *B66C 23/283* (2013.01)

(58) Field of Classification Search
CPC ..... B66C 23/283; B66C 23/00; B66C 23/18; B66C 23/26; B66C 23/28; B66C 23/286; B66C 23/30; B66C 23/305
See application file for complete search history.

(56) References Cited

U.S. PATENT DOCUMENTS 3,894,635 A * 7/1975 Reich ..... B66C 23/283 212/176
3,982,634 A * 9/1976 Miyazaki ..... B66C 23/283 212/179
4,028,792 A * 6/1977 Tax ..... B66C 23/283 29/431

FOREIGN PATENT DOCUMENTS

| | | | | |
|---|---|---|---|---|
| CN | 1267632 | | 9/2000 | |
| CN | 103407902 | | 11/2013 | |
| CN | 203345973 | | 12/2013 | |
| DE | 1456455 | | 3/1969 | |
| DE | 3337911 | | 5/1985 | |
| DE | 202005009236 | | 10/2006 | |
| EP | 1842822 | | 10/2007 | |
| EP | 1857670 | | 11/2007 | |
| FR | 1194146 | | 11/1959 | |
| GB | 1173524 | | 12/1969 | |
| JP | 05178566 A | * | 7/1993 | ..... B66C 23/283 |
| JP | 2009220901 | * | 1/2009 | ..... B66C 23/32 |

* cited by examiner

*Primary Examiner* — Michael R Mansen
*Assistant Examiner* — Juan J Campos, Jr.
(74) *Attorney, Agent, or Firm* — Levine Bagade Han LLP

(57) ABSTRACT

The present invention relates to a climbing device for a revolving tower crane having a climbing frame movable along, the crane tower for climbing in and/or climbing down tower sections, wherein a guide is provided for the longitudinally movable support of the climbing frame with respect to the crane tower. In accordance with the invention, the guide has resiliently flexibly supported and/or resiliently flexible transverse support elements transversely to the travel direction of the climbing frame.

21 Claims, 5 Drawing Sheets

CLIMBING DEVICE FOR A TOWER CRANE

CROSS-REFERENCE TO RELATED APPLICATIONS

This application is a continuation of International Patent Application No. PCT/EP2015/000529, filed Mar. 10, 2015, which claims priority to German Utility Model Nos. 20 2014 002 263.1, filed Mar. 11, 2014, and 20 2014 003 465.6, filed Apr. 24, 2014, issued Jun. 15, 2015, all of which are incorporated herein by reference in their entireties.

BACKGROUND

1. Technical Field

The present invention relates to a climbing, device for a revolving tower crane having a climbing frame movable along the crane tower for climbing in and/or climbing down tower sections, wherein a guide is provided for the longitudinally movable support of the climbing frame with respect to the crane tower.

2. Description of Related Art

Revolving tower cranes are typically adapted to the increasing height of the structure by the installation of additional tower sections. This procedure is generally called climbing. To be able to climb in a tower section, the upper crane part, which can comprise a crane boom, is typically released from the topmost tower section and is held by a climbing frame which is axially displaceably supported at the crane tower. After releasing the connection of the upper crane part from the topmost tower section, said climbing frame is moved so far upward that a further tower section can be fit between the released upper crane part and the topmost tower section and the upper crane part can then be placed on it or a further tower section can be placed on after a further climbing up.

Said climbing frame can surround the crane tower at the outside in the manner of a sliding sleeve and can have a lateral introduction opening through which a further tower section can be inserted or can also be removed again on the climbing down. It is alternatively also known to support the upper crane part temporarily with a lateral offset to the tower on the climbing frame during climbing up and climbing down so that the tower is freely accessible at the upper side to be able to place tower sections on or to remove them there. Said climbing frame is also longitudinally displaceably supported at the crane tower or at its tower sections in this case.

To be able to temporarily support the upper crane part together with the boom securely only on the climbing frame during climbing up and climbing down and to be able to take up corresponding moments of tilt and bending moments, the climbing frame is admittedly longitudinally displaceably supported at the crane tower by means of a guide, but is supported in a manner stable with respect to tilt. Such moments of tilt can arise, on the one hand, by wind loads, but, on the other hand, for example also by the taking up and letting down of tower sections which are to be climbed in and to be climbed down and which can be taken up and let down by the hoisting means at the crane itself.

The longitudinally displaceable guide of the climbing frame at the crane tower can in this respect comprise transverse support elements, for example in the form of sliding metal plates, which are, for example, attached to the climbing frame and which can engage around the crane tower from different sides. Sliding metal plates can, for example, engage at the longitudinal bars or corner bars of the tower sections typically formed as lattice girders to guide the climbing frame at the crane tower longitudinally displaceably, but in a manner stable against tilt. Instead of such sliding metal plates, guide rollers can also be provided at the climbing frame which can, for example, roll off at the corner bars of the tower sections.

The document DE 20 2005 009 236 U1, for example, shows a climbing device for tower cranes of the named kind.

With previous climbing devices of the named kind, relatively strong wear has previously resulted along the contact surfaces of the tower sections. This is particularly serious, for example, with cranes which are used at wind turbines since such cranes have to be climbed up and climbed down in a short time. In addition, juddering, abrupt displacement of the climbing frame has occasionally occurred when said climbing frame cannot be started or taken out of operation without jumping due to so-called slip-stick effects or when shape tolerances or dimensional tolerances result at the tower sections, in particular at their transition regions, which are too large and which can results in microtilts or even in jamming tendencies of the climbing frame. Such jumpy movements of the climbing frame are, however, highly unwanted since the climbing frame supports the whole upper crane part, including the boom, during its travel movement.

SUMMARY OF THE INVENTION

It is the underlying object of the present invention to provide an improved climbing device of the initially named kind which avoids disadvantages of the prior art and further develops the latter in an advantageous manner. The climbing device should in particular be able to be traveled in a manner as free of jumping and as low in wear as possible without sacrificing the tilt stability of the climbing device with respect to the crane tower for this purpose.

The named object is achieved in accordance with the invention by a climbing device in accordance with claim 1. Preferred embodiments of the invention are the subject of the dependent claims.

It is therefore proposed to configure the longitudinally travelable guide of the climbing frame at the crane tower as self-adjusting with respect to shape tolerances and/or dimensional tolerances which can occur along the travel path so that said shape tolerances and/or dimensional tolerances can be compensated by the longitudinally travelable guide. The longitudinally travelable guide is resilient in the transverse direction for this purpose so that overhangs or excess dimensions can be taken up and so that in the case of dimensions being too small the guide surfaces can move closer to maintain the guide surface engagement and thus to maintain the tilt stability. In accordance with the invention, the guide has resiliently flexibly supported and/or resiliently flexible transverse support elements transversely to the travel direction of the climbing frame. Said transverse support elements absorb transverse forces transversely to the direction of travel of the climbing frame and/or transversely to the longitudinal direction of the crane tower and support the climbing frame in said transverse direction at the crane tower, but in so doing allow a travel in the longitudinal direction. If, for example, a projecting contour section, for example at the join point between two tower sections, is traveled over during climbing up, the corresponding transverse support element can yield so that the climbing frame can move gently over said contour point while, conversely, with a reducing contour section, the transverse support element tracks the transverse support element resiliently and maintains the support contact and thus the tilt stability.

In an advantageous further development of the invention, the resiliently, flexibly supported and/or configured transverse support elements can be configured as guide rollers which are rotatably supported about an axle of rotation which extends transversely to the direction of travel of the climbing frame. The resilient flexibility of the guide roller transversely to its axle of rotation and/or transversely to the longitudinal direction of the tower can be achieved by a resilient flexibility of the guide roller itself, for example by configuration as a rubber roller. Alternatively or additionally, however, the axle of rotation of the guide roller can advantageously also be resiliently flexibly supported transversely to the direction of travel so that an approximately rigid guide roller can be used, for example composed of a metallic material or of a hard plastic.

In an advantageous further development of the invention, the guide rollers or transverse support elements can each be individually resiliently flexibly supported in the sense of an independent suspension. It would generally also be conceivable to combine two or more of the transverse support elements with respect to the resiliently flexible support at one side of the climbing frame, for example such that they are arranged at a common, movable bearing or swing-arm element. An independent suspension mutually independent of one another with respect to the compensation movements, however, makes possible a more sensitive adaptation to shape tolerances and load cases so that the climbing frame can be traveled more harmoniously overall.

The transverse support elements or guide rollers can in particular each be fastened or rotatably supported at a support element carrier which is movably supported transversely to the direction of travel of the climbing frame and which can be preloaded into the support position or engagement position by the aforesaid spring device. If the corresponding support element is provided at the climbing frame, the support element carrier can be preloaded onto the crane tower by the spring device so that the support element is pressed against the crane tower. In general, it would also be conceivable to provide corresponding transverse support elements at the tower sections of the crane tower, with then the respective transverse support element in this case being clamped beforehand to the climbing frame. Such a tower-side arrangement, however, requires corresponding transverse support elements at a plurality of tower sections. An arrangement of the transverse support elements at the climbing frame side is clearly of advantage with respect to a reduced number of components.

To allow a sensitive, fast-responding transverse movement of the transverse support elements, the aforesaid support element carrier at which a respective transverse support element or a corresponding guide roller is supported can be supported by a plurality of spring elements in an advantageous further development of the invention, with advantageously two spring elements being able to engage at said support element carrier at different sides of the transverse support element so that the support element carrier can also carry out slight tilt movements in addition to transverse movements.

The spring elements can be mechanical in this respect. Alternatively or additionally, pneumatic or hydraulic spring elements can also be provided. It would generally also be possible to configure the guide rollers as pneumatically and/or hydraulically resilient.

In a further development of the invention, the longitudinally displaceable guide of the climbing frame is configured with respect to the crane tower such that the transverse flexibility of the transverse support elements and/or the transverse flexibility of the climbing frame with respect to the crane tower which is made possible thereby is only limited, in particular such that no significant tilt movements of the climbing frame are possible with respect to the crane tower. A transverse flexibility limiter of the guide apparatus can be directly associated with the resiliently flexibly supported transverse support elements and can provide that the resilient flexibility of said transverse support elements is only limited or the transverse support elements are only transversely adjustable by a relatively small, limited amount. The transverse adjustability or transverse flexibility of the resiliently flexibly supported transverse support elements can, for example, be limited by abutments against which a movable support section of the transverse support elements moves. The axle of rotation of the guide rollers can, for example, be guided in an elongate whole which only allows a limited transverse adjustability of the guide rollers.

Alternatively or additionally, said flexibility limiter can also comprise further transverse support elements which are not resiliently flexibly supported or are not resiliently flexible, but are rather substantially rigid or non-flexible transversely to the direction of travel of the climbing frame. To avoid the aforesaid wear problems and jamming tendency due to such rigid transverse support elements, these additional rigid transverse support elements can be arranged a little further recessed with respect to the resiliently flexibly supported and/or configured transverse support elements, at least when the latter are in their non-deflected desired position or neutral position, so that said rigid additional transverse support elements are out of engagement when the resiliently flexible transverse support elements are not deflected or when the climbing frame is in a neutral position in which the resiliently flexible transverse support elements hold the climbing frame. Said additional rigid transverse support elements can in particular be arranged with respect to one another at the climbing frame such that they only engage the crane tower or a respective tower section with air or form a clearance fit with respect to the associated support surfaces at the respective tower section.

Said additional transverse support elements arranged non-flexibly transversely to the direction of travel can generally be configured differently, for example can likewise be configured as guide rollers. In a further development of the invention, said additional transverse support elements can, however, also be formed as plain bearings, in particular in the form of sliding metal plates, which can engage around the longitudinal ties or corner bars of the crane tower with clearance in said manner.

BRIEF DESCRIPTION OF THE FIGURES

The invention will be explained in more detail in the following with reference to a preferred embodiment and to associated drawings. There are shown in the drawings.

DETAILED DESCRIPTION

Figure 1:
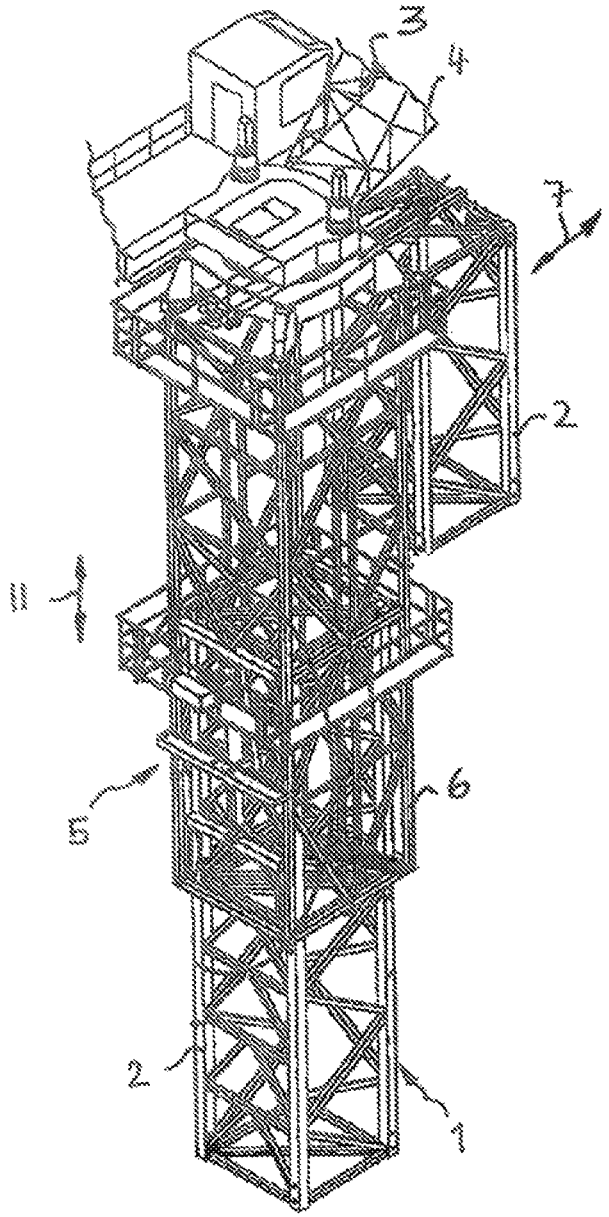
FIG. 1: a perspective part view of a climbing device for a revolving tower crane which shows the climbing frame at the crane tower and a tower section to be inserted therewith.
Figure 2:
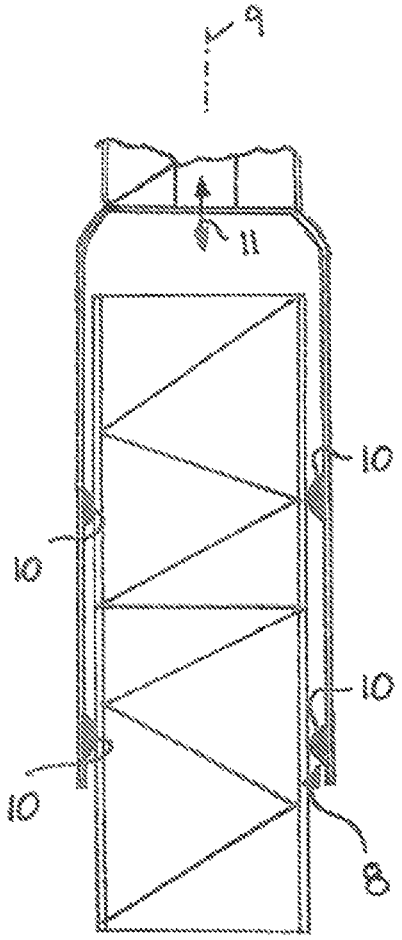
FIG. 2: a schematic representation of the longitudinally displaceable guide and its transverse support elements for the longitudinally displaceable support of the climbing frame with respect to the crane tower.

As FIGS. 1 and 2 show, a crane tower 1 of a revolving tower crane can be composed in a manner known per se of a plurality of tower sections 2 which can each be formed as frame carriers and which can be placed onto one another in the region of their corner bars and which can be latched to one another, for example bolted to one another. An upper crane part 3, which is only shown in detail and not completely, can be provided in a manner known per se at the upper end of the crane tower 1 and can, for example be rotatable with respect to the crane tower 1 via a revolving crane support when the crane is a top-slewer and can comprise a boom 4 via which a hoisting rope can run off in a manner known per se, for example over a trolley.

To be able to increase or extend the crane tower further and further with a structure growing upward, a climbing device 5 is provided by means of which the upper crane part 3 can be raised a little and further tower sections 2 can be inserted or placed onto the previously topmost tower section in order then again to be able to be place the upper crane part 3 onto the just inserted topmost tower section.

Said climbing device 5 for this purpose comprises a climbing frame 6 which is supported at the crane tower 1 in the longitudinal direction thereof and in a travelable or displaceable manner so that the climbing frame 6 can be displaced up and down at the crane tower 1. Said climbing frame 6 can likewise be formed as a system of bars, with, however, other structures also being able to be used such as plate metal section frames, shell constructions and the like. Said climbing frame 6 is in this respect advantageously formed overall—in rough terms—as sleeve shaped and with its inner periphery adapted contour-wise and dimension-wise to the outer periphery of the crane tower 1 so that the climbing frame 6 can be pushed over the crane tower 1 in the manner of a cuff or sleeve and a small gap remains between the outer contour of the crane tower 1 and the inner contour of the climbing frame 6 in which gap guide elements still to be explained are provided for guiding the climbing frame 6 at the crane tower 1.

The traveling of the climbing frame 6 along the crane tower 1 can be effected in different manners, for example by means of a support shoe which can be telescoped in and out and at which a power lift such as a hydraulic cylinder cart engage to be able to press the climbing frame 6 upwardly or to be able to let it down with respect to the crane tower 1.

As FIG. 1 indicates, the climbing frame 6 can comprise an insertion opening at one side through which an additional tower section 2 can be inserted, as arrow 7 indicates, or can also be pushed out when the crane tower 1 is to be dismantled or lowered.

As FIG. 2 shows, the climbing frame 6 can be supported by a guide 8 in a longitudinally travelable manner at the crane tower 1 so that the climbing frame 6 can be traveled up and down in parallel with the tower axis 9, but cannot tilt with respect to the crane tower 1.

The guide 8 for this purpose comprises a plurality of transverse support elements 10 which engage at different sides of the crane tower 1, which support transverse forces of the climbing frame 6 at the crane tower 1 and which prevent transverse movements of said climbing frame 6 and/or tilt movements of the climbing frame 6 with respect to the crane tower 1. The guide 8 forms a longitudinal guide which substantially only allows a uniaxial movement of the climbing frame 6, namely a displacement or a travel in the longitudinal direction in accordance with the arrow 11.

Transverse support elements 10 arranged in pairs at oppositely disposed sides can in particular be provided at the climbing frame 6 and the crane tower 1 is received with an exact fit between them.

Said transverse support elements 10 can be supported on the longitudinal ties or corner bars of the tower sections 2, cf. FIG. 2.

Figure 3:
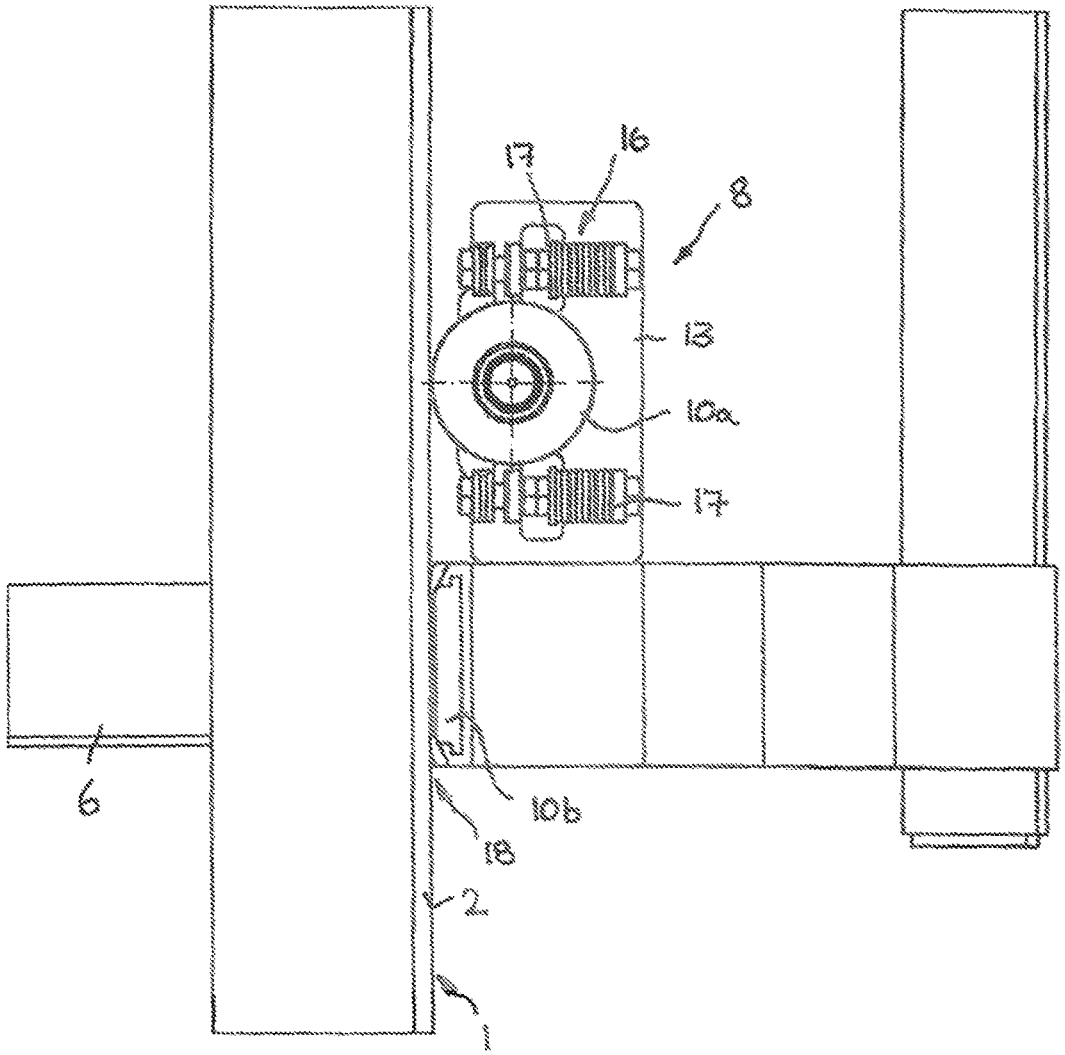
FIG. 3: a detailed, enlarged, partly sectional representation of a resiliently flexibly supported transverse section element and a non-flexibly supported transverse section element of the longitudinally displaceable guide of the climbing frame with respect to the crane tower from the preceding Figures.
Figure 4:
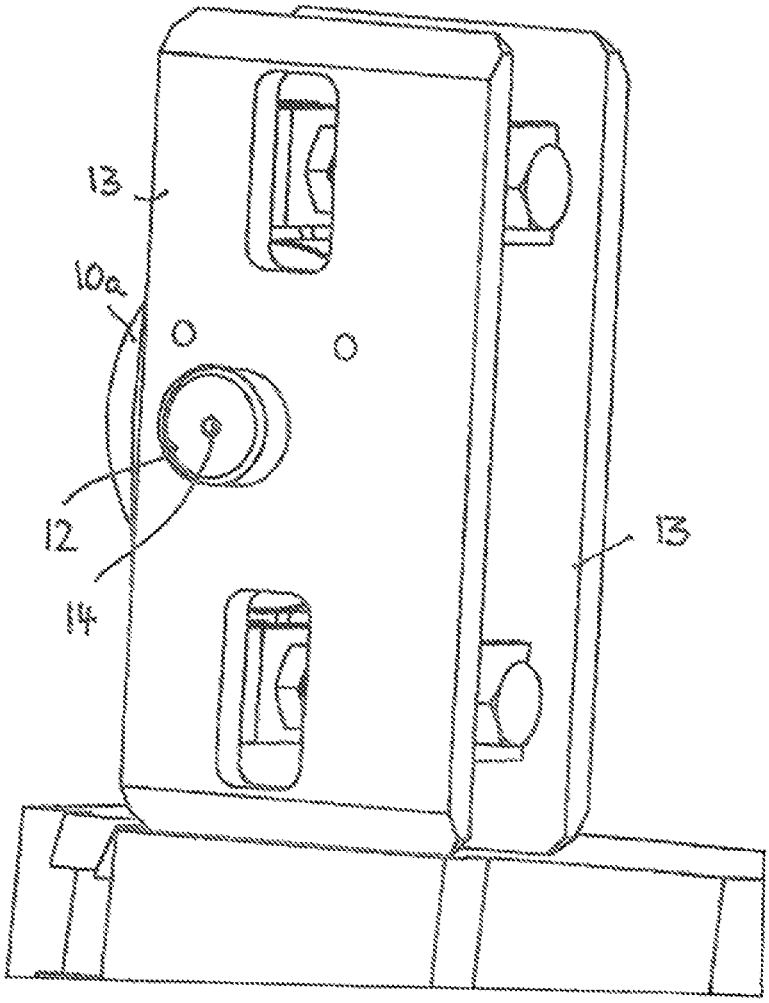
FIG. 4: a perspective representation of the displaceable support of the guide roller of FIG. 3 which shows the reception of the axle of rotation of the guide roller in an elongate hole.

As FIGS. 3 and 4 show, said transverse support elements 10 can comprise two different types of support elements, namely, on the one hand, resiliently flexibly supported guide rollers 10*a* and, on the other hand, non-flexible, substantially rigid sliding metal plates 10*b*. Said guide rollers 10*a* and the sliding metal plates 10*b* can be arranged in respective pairs in direct proximity or in the direct vicinity of one another, for example such that a respective rigid sliding metal plate 10*b* is arranged next to a flexibly supported guide roller 10*a*, cf. FIG. 3, to locally intercept or limit the flexibility of the guide roller 10.

As FIG. 2 shows and as already explained above, such mutually associated guide rollers 10*a* and sliding metal plates 10*b* can each be arranged at different sides of the climbing frame 6 and can be provided in a plurality of groups axially spaced apart from one another so that the crane tower 1 is engaged around from a plurality of sides, in particular sides respectively disposed opposite one another in pairs, in particular from all sides, or so that the climbing frame 6 is supported with tilt stability with respect to the crane tower 1.

Figure 5:
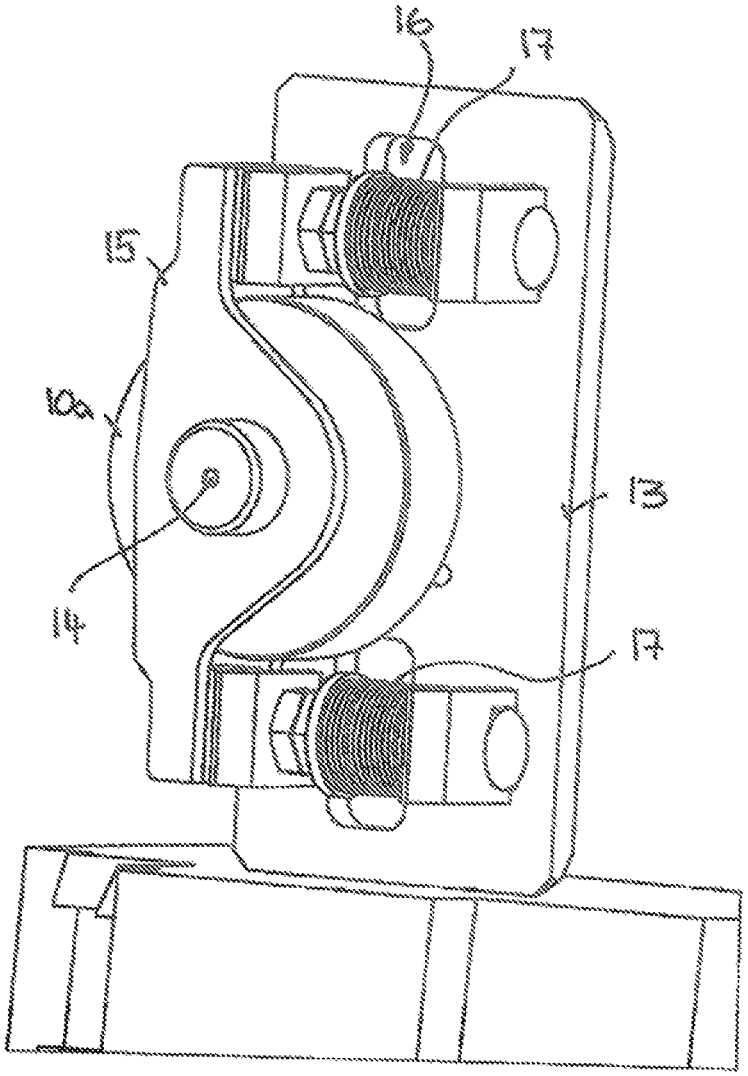
FIG. 5: a partly exposed, perspective representation of the spring suspension of the guide roller of FIGS. 3 and 4.

As FIGS. 3-5 show, said guide rollers 10*a* are resiliently flexibly supported transversely to the direction of travel 11 of the climbing frame 6 so that the guide rollers 10*a* can yield outwardly transversely to the peripheral side and can move back again automatically under a preload force or spring force.

The respective guide roller 10*a* can for the purpose be displaceably guided with its axle of rotation 14 in a guide slit 12 of preferably elongate hole form of a guide frame part 13 so that the guide roller 10*a* can be moved toward the respective tower section 2 and can be pressed away from it, and indeed advantageously substantially perpendicular to the longitudinal direction of the respective longitudinal tie of the tower section 2.

In order to preload the guide roller 10*a* or to apply a spring force to it which presses the guide roller 10*a* against the tower section 2, said axle of rotation 14 of the respective guide roller 10*a* is fastened to a support element carrier 15 which is movable with respect to the aforesaid guide frame part 13 and which is supported by a spring device 16. Said spring device 16 can advantageously comprise at least two spring elements 17 which can be arranged at both sides of the guide roller 10*a* or of its axle of rotation 14 and can, on the hand, be supported at the guide frame part 13 and, on the other hand, at the support element carrier 15 so that the support element carrier 15, and thus the guide roller 10*a*, is loaded against the tower section 2.

The travel capability of the guide roller 10*a* is limited transversely to the longitudinal tower axis 9 or transversely to the direction of travel 11 by the reception of the axle of rotation 14 in the guide slit 12 of elongate hole form, with defined end positions advantageously also being provided at the end of the possible travel path. On the one hand, the spring device 16 presses the axle of rotation 14 against the one end of the guide slit 12 of elongate hole form. If the spring forces are overcome, the guide roller 10*a* can escape or deflect until the end position of the spring device 10 and/or the oppositely disposed end of the guide slit 12 of elongate hole form is reached.

In addition to the resiliently flexibly supported guide rollers 10*a*, the guide 8 comprises the aforesaid sliding metal plates 10*b* which can be substantially non-flexible, in particular rigid and which can be arranged transversely to the direction of travel 11.

The arrangement of the non-flexible sliding metal plates 10*b* can in this respect be made such that said sliding metal plates 10*b* are spaced apart from or out of engagement with the support surfaces at the crane tower 1, in particular the longitudinal tie surfaces or corner bar surfaces, with here only a slight spacing advantageously being provided which is smaller than the maximum possible deflection path of the guide rollers 10*a*. A slight clearance fit between the sliding metal plates 10*b* and the tower surface can in particular be provided, at least as long as the guide rollers 10*a* are in a neutral position or at least not in their completely deflected position, so that the sliding metal plates 10*b* can slide along the tower sections 12 free of resistance and wear. As FIG. 3 shows, the sliding metal plates 10*b* easily have air with respect to the tower surface. On the other hand, the sliding metal plates 10*b* stabilize the climbing frame 6 with respect to the crane tower 1 when the guide rollers 10*a* deflect, that is the sliding metal plates 10*b* then come into contact, with the surface of the crane tower and additionally support the climbing frame 6 and/or prevent too far a deflection of the guide rollers 10*a*.

The tilting torque applied at the climbing frame 6 can be visually recognized by said deflected guide rollers 10*a* and a jolt-free climbing process can be carried out by corresponding compensation measures. An unwanted slip-stick effect can be prevented.

Furthermore, the wear of the contact surfaces of the guide 8 of the climbing flame 6 at the crane tower 1 is reduced to a minimum, whereby long service lives of the tower sections 2 and the sliding metal plates 10*b* can be achieved. Said sliding metal plates 10*b* only serve as a metal contact plate or only as an actually engaging sliding metal plate in an emergency.

Rust formation can also be significantly reduced by the greatly reduced wear at the contact surfaces.

We claim:

1. A climbing device for a revolving tower crane and a crane tower, the crane tower having a crane tower longitudinal axis and a crane tower transverse axis, the climbing device comprising:

a climbing frame travelable along the crane tower longitudinal axis for climbing in and/or climbing down tower sections; and a guide for supporting travel of the climbing frame with respect to the crane tower along the crane tower longitudinal axis, wherein the guide comprises resiliently flexible spring-loaded transverse supporters travelable along the crane tower transverse axis.

2. The device of claim 1, wherein the resiliently flexible spring-loaded transverse supporters comprise guide rollers.

3. The device of claim 1, wherein the resiliently flexible spring-loaded transverse supporters are preloaded into a guide engagement position toward a tower surface by a spring device.

4. The device of claim 1, further comprising a support element carrier supporting a respective resiliently flexible spring-loaded traverse supporter of the resiliently flexible spring-loaded transverse supporters, and wherein the support element carrier is supported in a transversely travelable manner by two spring elements arranged at different sides of the transverse support element.

5. The device of claim 1, wherein the guide comprises a flexibility limiter for limiting yield transversely to the crane tower longitudinal axis.

6. The device of claim 1, wherein the guide further comprises non-flexibly supported transverse support elements non-flexibly supported transversely to the crane tower longitudinal axis.

7. The device of claim 6, wherein the non-flexibly supported transverse support elements are out of engagement and/or are only in engagement in clearance with an associated support surface when the resiliently flexible spring-loaded transverse supporters are in a non-deflected neutral position.

8. The device of claim 7, wherein the non-flexibly supported transverse support elements are set back from a crane tower surface with respect to the resiliently flexible spring-loaded transverse supporters when the resiliently flexible spring-loaded transverse supporters are in an outwardly deflected position, wherein an offset away from the crane tower surface is smaller than a maximum deflection path of the resiliently flexible spring-loaded transverse supporters.

9. The device of claim 8, wherein the non-flexibly supported transverse support elements are configured as plain bearings comprising sliding metal plates.

10. The device of claim 7, wherein the non-flexibly supported transverse support elements are configured as plain bearings comprising sliding metal plates.

11. The device of claim 6, wherein the non-flexibly supported transverse support elements are set back from a crane tower surface with respect to the resiliently flexible spring-loaded transverse supporters when the resiliently flexible spring-loaded transverse supporters are in an outwardly deflected position, wherein an offset away from the crane tower surface is smaller than a maximum deflection path of the resiliently flexible spring-loaded transverse supporters.

12. The device of claim 11, wherein the non-flexibly supported transverse support elements are configured as plain bearings comprising sliding metal plates.

13. The device of claim 6, wherein the non-flexibly supported transverse support elements are configured as plain bearings comprising sliding metal plates.

14. The device of claim 1, wherein the resiliently flexible spring-loaded transverse supporters are at a plurality of sides of the climbing frame and/or wherein the resiliently flexible spring-loaded transverse supporters have a longitudinal axis parallel with the crane tower longitudinal axis.

15. The device of claim 14, wherein the resiliently flexible spring-loaded transverses supporters are in pairs on respectively opposite sides of the climbing frame, and wherein a tower section can be received with an exact fit between the resiliently flexible spring-loaded transverses supporters.

16. The device of claim 1, wherein the guide comprises guide rollers at a plurality of sides of the climbing frame, wherein the guide rollers are preloaded in mutually opposite directions and/or are resiliently flexibly supported in mutually oppositely disposed directions.

17. A climbing device for a revolving tower crane and a crane tower, the crane tower having a crane tower longitudinal axis and a crane tower transverse axis, the climbing device comprising:

tower sections;

a climbing frame travelable along the crane tower longitudinal axis for climbing the tower sections; and a guide for supporting travel of the climbing frame with respect to at least one of the tower sections along the crane tower longitudinal axis, wherein the guide comprises resiliently flexible spring-loaded transverse supporters travelable along the crane tower transverse axis.

18. The device of claim 17, wherein the resiliently flexible spring-loaded transverse supporters elements comprise guide rollers.

19. A climbing device for a revolving tower crane and a crane tower, the crane tower having a crane tower longitudinal axis and a crane tower transverse axis, the climbing device comprising:

tower sections;

a climbing frame travelable along the crane tower longitudinal axis for climbing the tower sections; and guide rollers at a plurality of sides of the climbing frame, wherein the guide rollers apply forces in mutually opposite directions, wherein the guide rollers are resiliently flexibly supported in mutually oppositely disposed directions, wherein the guide rollers are resiliently flexibly biased to maintain contact with a tower section during longitudinal travel of the climbing frame when the climbing frame travels from a first longitudinal climbing position on the tower section to a second longitudinal climbing position on the tower section.

20. The device of claim 19, further comprising spring elements, wherein the spring elements are configured to force load the guide rollers against a surface of at least one tower section.

21. A climbing device for a revolving tower crane and a crane tower, the crane tower having a crane tower longitudinal axis and a crane tower transverse axis, the climbing device comprising:

a climbing frame travelable along the crane tower longitudinal axis; and a climbing guide travelable along the crane tower transverse axis, wherein the climbing guide comprises:

a resiliently flexible transverse supporter having a non-deflected neutral position and a deflected position, and a non-flexible rigid sliding transverse supporter having a first position and a second position, wherein when the non-flexible rigid sliding transverse supporter is in the first position, there is a space between the crane tower and the non-flexible rigid sliding transverse supporter, wherein when the non-flexible rigid sliding transverse supporter is in the second position, the non-flexible rigid sliding transverse supporter contacts the crane tower, wherein when the resiliently flexible transverse supporter is in the non-deflected neutral position, the non-flexible rigid sliding transverse supporter is in the first position, and wherein when the resiliently flexible transverse supporter is in the deflected position, the non-flexible rigid sliding transverse supporter is in the second position.

* * * * *